US005414887A

United States Patent [19]

Abel et al.

[11] Patent Number: 5,414,887

[45] Date of Patent: May 16, 1995

[54] APPARATUS FOR CLEANING AIR PORTS OF A CHEMICAL RECOVERY FURNACE

[75] Inventors: Clayton J. Abel, Beaverton; Daniel R. Higgins, Portland; Kenneth A. Pingel, Hillsboro, all of Oreg.

[73] Assignee: Anthony-Ross Company, Beaverton, Oreg.

[21] Appl. No.: 923,242

[22] Filed: Jul. 31, 1992

[51] Int. Cl.[6] ..... B08B 9/08

[52] U.S. Cl. ..... 15/104.16; 15/249; 15/104.07

[58] Field of Search ..... 15/246, 249, 93.2, 104.05, 15/104.07, 104.02, 104.16; 122/387

[56] References Cited

U.S. PATENT DOCUMENTS 2,390,197 12/1945 Voorhees et al. ..... 15/104.16
2,391,443 12/1945 Bruton ..... 15/104.16
3,025,548 3/1962 Benkenstein ..... 15/104.16
3,918,375 11/1975 Hayakawa et al. ..... 15/104.16
3,995,344 12/1976 Meyers ..... 15/104.07
4,095,306 6/1978 Norton ..... 15/104.07
4,233,119 11/1980 Meyers et al. ..... 15/93.2
4,277,312 7/1981 McKenna et al. ..... 15/93.2
4,380,842 4/1983 Thomas ..... 15/104.07
4,603,747 8/1986 Golden ..... 15/104.07
4,822,428 4/1989 Goodspeed ..... 15/246

*Primary Examiner*—David A. Scherbel
*Assistant Examiner*—James F. Hook
*Attorney, Agent, or Firm*—Dellett and Walters

[57] ABSTRACT

Apparatus for cleaning air ports in a chemical recovery furnace comprises an elongated cleaning rod provided with a tip on one end adapted to be inserted through an air port with a ramming motion to dislodge residual build-up. The cleaning tip is substantially smaller than the air port. Between ramming motions, the rod carrying the tip is moved a fraction of the distance around the inside edge of the air port so that successive insertions of the tip will dislodge or sever the residual material build-up.

10 Claims, 8 Drawing Sheets

APPARATUS FOR CLEANING AIR PORTS OF A CHEMICAL RECOVERY FURNACE

BACKGROUND OF THE INVENTION

The present invention relates to furnaces and particularly to apparatus for automatically cleaning ports introducing combustion air into the firebox of a chemical recovery furnace.

Wood pulp for papermaking is usually manufactured according to the sulfate process wherein wood chips are treated with a cooking liquor including sodium sulfide and sodium hydroxide. The wood chips and the cooking liquor, called "white liquor," are cooked in a digester under predetermined heat and temperature conditions. After cooking, the used liquor, termed "black liquor," containing spent cooking chemicals and soluble residue from the cook, is washed out of the pulp and treated in a recovery unit where the cooking chemicals are reclaimed. Without reclamation and reuse of the cooking chemicals, the cost of the papermaking process would be prohibitive.

In the recovery process, the black liquor is first concentrated by evaporation to a water solution containing about 65 percent solids, which solution is then sprayed into the firebox of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials in the black liquor, lignin and other wood extracts, maintain combustion in the firebox, and the heat produced melts the spent cooking chemicals. A molten smelt flows out of the furnace through a smelt spout to a collection tank. Concurrently, combustion heat is employed to generate steam in a wall of boiler tubes for use as process steam and for generating electricity.

The combustion process requires the introduction of large volumes of air into the firebox, air comprising about 80 percent of the material entering the furnace. The air is forced into the firebox from wind boxes or ducts disposed at several levels in surrounding relation to the firebox, through a plurality of air ports in the walls of the furnace, viz.: primary, secondary, and tertiary air ports.

The black liquor sprayed into the firebox, having a consistency similar to that of warm 60 weight oil, swirls, burns and falls toward the bottom of the firebox as combustion products comprising char material and smelt. The smelt and char material contact the outer walls of the firebox and, cooled by the inflowing air, form excrescent deposits around edges of the air ports, particularly along the edges of the openings where the excrescent material builds up under influence of air rushing through the air port. Such buildups of char material can block air flow through the ports by as much as ten percent, and can even block individual ports completely. In accordance with prior practice, the char build-up is periodically removed by a worker inserting a rod into the air ports successively around the boiler. With manual rodding of the air ports, gradual build-up of char material intermittently around the furnace still causes changes in the volume of combustion air, as well as changes in air distribution, velocity and pressure. Therefore, furnace operation tends to be inefficient and unpredictable with an attendant decrease in the quantity of chemical that can be recovered, a decrease in the amount of steam produced per unit of fuel, and increased emission of noxious gases such as carbon monoxide and sulfur dioxide.

Apparatus for automatically cleaning openings in a recovery furnace is known—see U.S. Pat. No. 4,748,004, entitled APPARATUS FOR CLEANING AIR PORTS OF A CHEMICAL RECOVERY FURNACE, and U.S. Pat. No. 4,423,533, entitled FURNACE AIR PORT CLEANER. The apparatus disclosed in these patents includes rods with cleaning tips attached to ends thereof, and the cleaning action comprises a wiping motion accomplished by inserting the cleaning tips into corresponding openings and then changing the position of the rods, while the cleaning tips are within the openings, so as to cause the cleaning tips to move lengthwise of the openings to dislodge the build-up therein. It has been found that particularly hard deposits of solidified smelt and char material resembling a vitreous substance may resist the wiping action of the cleaning tip and in extreme instances may cause individual rods to stress and even bend. It is desirable therefore to provide a cleaning action in which the cleaning tip acts as a ram, i.e. wherein force is applied longitudinally of the rod while still being able to clean the longitudinal height of the air port opening without disrupting or blocking combustion air flow.

Apparatus in accordance with U.S. Pat. No. 4,822,428 entitled APPARATUS FOR CLEANING AIR PORTS OF A CHEMICAL RECOVERY FURNACE comprises a plurality of rods each having a cleaning tip adapted for insertion through a furnace air port, as a result of longitudinal translation of the cleaning rod, for dislodging excrescent material. The cleaning tip is then retracted and indexed to a different location along the narrow opening, and the insertion operation is repeated. Excrescent material is forceably removed along the entire air port without wiping the cleaning tip along the opening when it is inserted in the air port. The described apparatus has proved quite advantageous especially in the case of primary air ports near the bottom of a furnace close to the char bed. These air ports are relatively long and narrow and the cleaning tip has a width comparable to the narrow dimension of the air port. The tip is indexed vertically, i.e. along the direction of the greater dimension of the air port, for repeatedly ramming through the deposited material.

Secondary and tertiary air ports, on the other hand, are higher up in the furnace wall and have larger width dimensions. Also, the width dimension typically varies as dictated by the outline of boiler tubes inside the furnace wall which are spread to accommodate the air port. Neither the aforementioned air port cleaner having a wiping movement within the air port opening, nor the air port cleaner which successively rams through the deposited material along a narrow air port are advantageous in the case of secondary and tertiary air port cleaning.

Furthermore, although an air port cleaner consisting of a large plate or ram may be utilized for cleaning larger air ports, the use of these larger dimensioned devices is disadvantageous in that they may block the flow of air through the port when the cleaning operation is taking place. It would be desirable to be able to employ an air port cleaner having a cleaning tip which is relatively small in comparison to the opening being cleaned.

SUMMARY OF THE INVENTION

According to the present invention, in a preferred embodiment thereof, furnace air ports are automatically cleaned by apparatus comprising a rod having a small cleaning tip adapted for insertion through the port by longitudinal translation of the rod to provide a ramming action. After an insertion, the rod and tip are removed and indexed part way around the peripheral edge of the air port to dislodge or perforate the build-up of material. The cleaning tip is translated in "x and y" lateral directions between ramming insertions so that a point of next insertion will be along a peripheral path just inside the edge of the port. The tip proceeds around the inside edge of the port to perforate and sever or otherwise dislodge the body of material as may block air flow through the port.

In accordance with a preferred embodiment of the present invention, withdrawal of the rod carrying the cleaning tip is effective for operating first and second camming means which index the next insertion point of the cleaning tip in x and y lateral directions so that successive insertions follow a path around the inside edge of the port.

It is accordingly an object of the present invention to provide improved apparatus for cleaning air ports of a chemical recovery furnace.

Another object of the present invention is to provide improved air port cleaning apparatus for increasing the operational stability of a black liquor recovery boiler.

It is another object of the present invention to provide an improved method and apparatus for removing material blocking secondary and tertiary air ports in a chemical recovery furnace without resorting to a large cleaning element as would block air flow through the air port opening.

It is a further object of the present invention to provide an improved air port cleaning apparatus for cleaning ports having a relatively large and variable width dimension.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figures 1, 2:
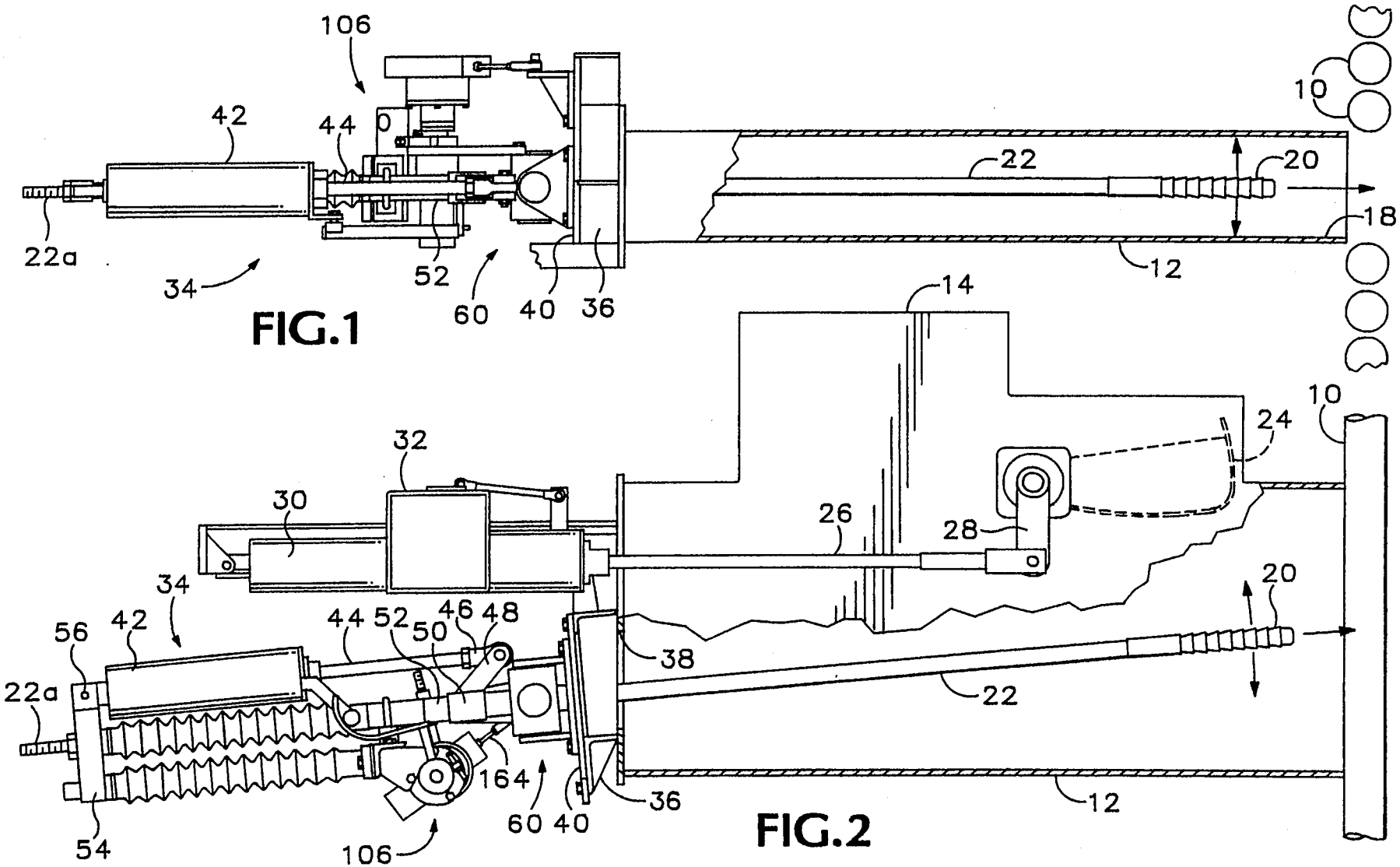
FIG. 1 is a plan view of apparatus according to the present invention.
FIG. 2 is a side view of the FIG. 1 apparatus, shown partially broken away.
Figure 7:
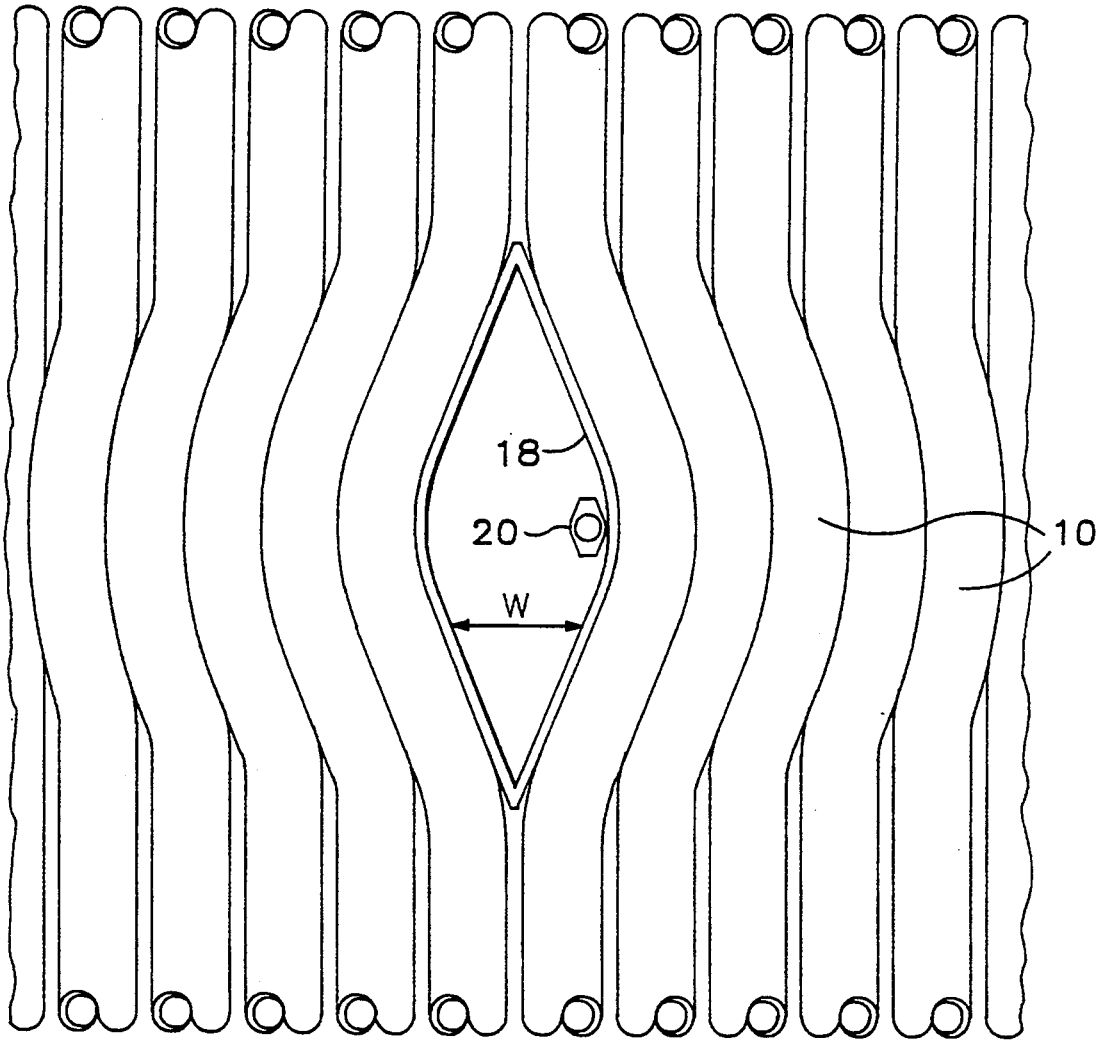
FIG. 7 is a view from inside a chemical recovery furnace illustrating boiler tubes, a secondary air port and a cleaning tip according to the apparatus of the present invention.

Referring to the drawings and particularly to FIGS. 1 and 2, the present invention is adapted for use in connection with a chemical recovery furnace provided with a plurality of vertically extending boiler tubes 10 between which a secondary or tertiary air port is defined. A plenum chamber or housing 12 receives inlet air through a duct opening 14 from a windbox, the air being expelled at opening 18 (see also FIG. 7) between spread apart boiler tubes 10. The typical opening is somewhat oval in shape, having a variable width dimension "w", that changes from zero at the upper and lower extremities of the opening, and which is greatest midway therealong. Serrated cleaning tip 20 mounted upon rod 22 is substantially smaller in lateral, i.e. x and y dimensions, than the opening, but is adapted for being inserted through the opening for cleaning excrescent material from the edges thereof. This tip is substantially as described in aforementioned U.S. Pat. No. 4,822,428.

Mounted in the same housing or plenum is a damper mechanism comprising a rotatable damper 24 operated from damper rod 26, exterior to the housing, by way of crank 28. The damper rod 26 comprises the piston rod of damper air cylinder 30 mounted at the end of housing 12 farthest from the air port opening and controlled by positioner 32 in accordance with desired degree of air flow into the furnace.

Figure 3:
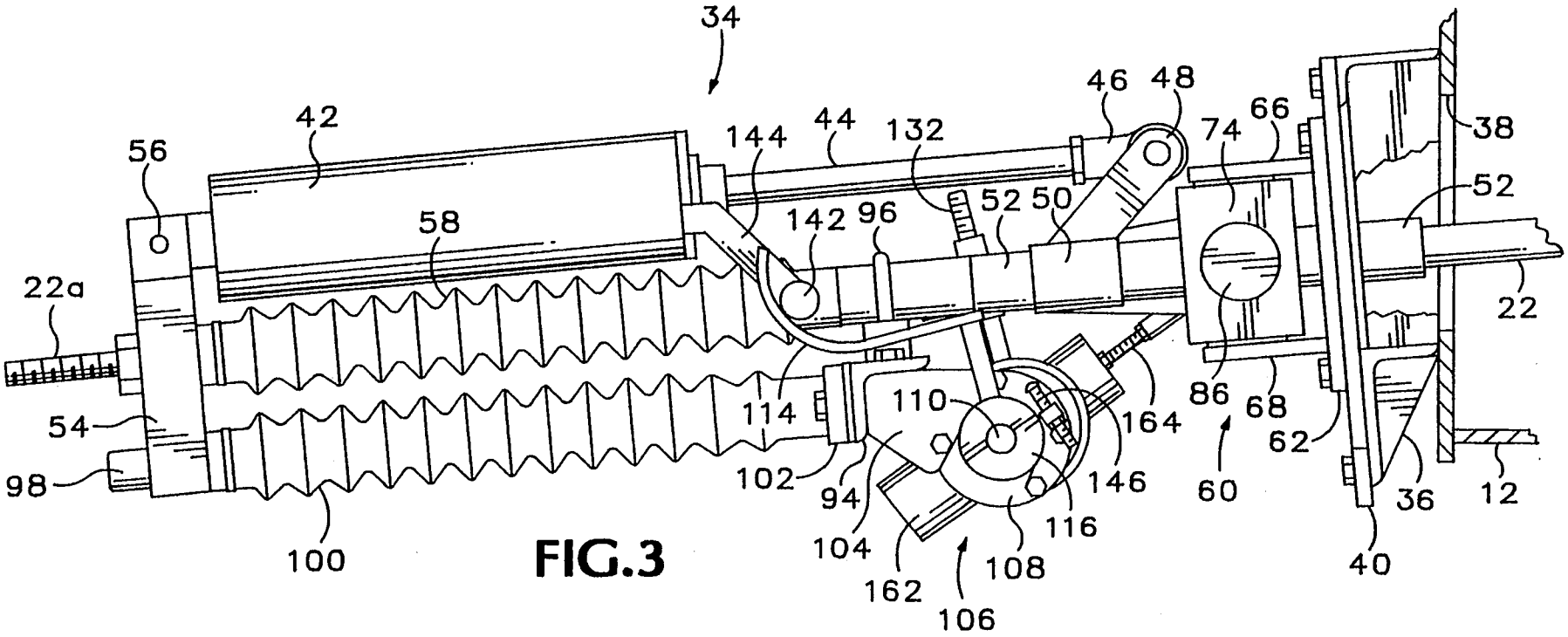
FIG. 3 is a more detailed side view of the above apparatus in particular regard to the means for longitudinally and laterally translating the cleaning rod.
Figure 4:
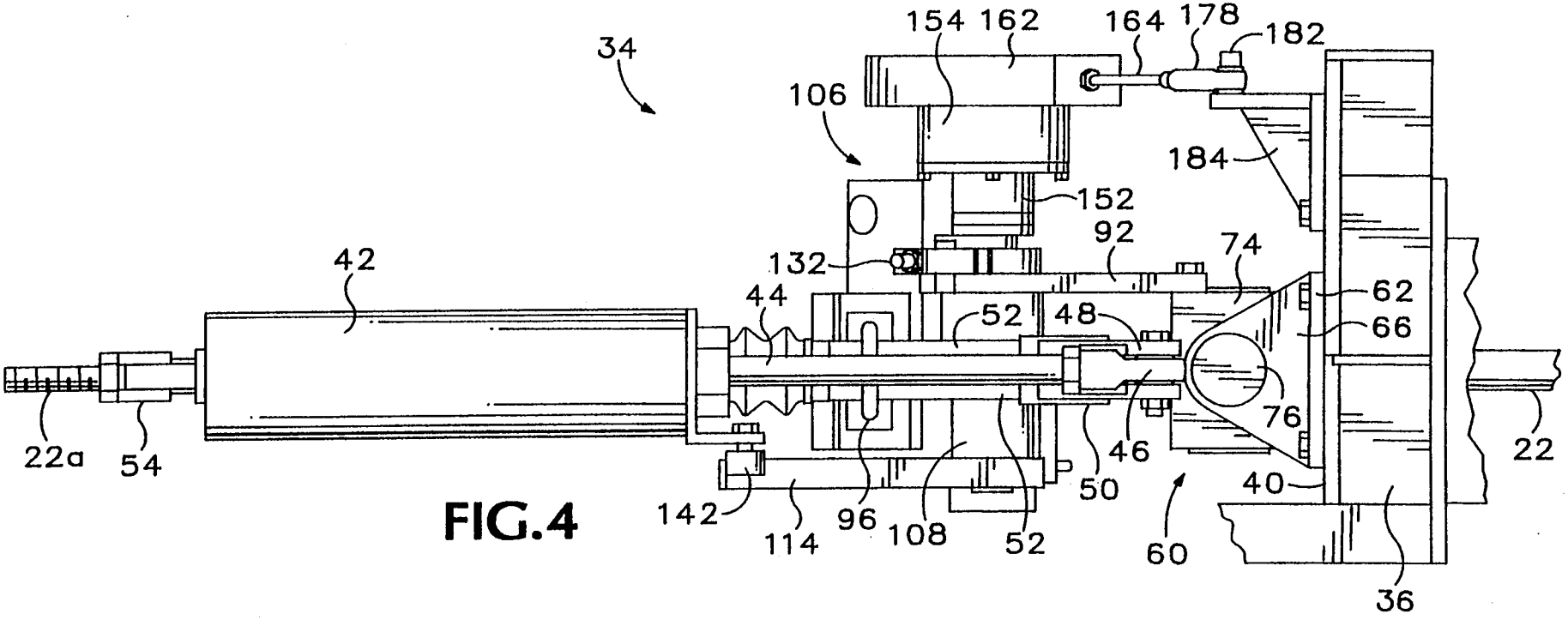
FIG. 4 is a top view of the FIG. 3 portion of the apparatus.

Actuating apparatus for rod 22 and tip 20 is depicted at the 34 in FIGS. 1 and 2 as well as in a more detailed manner in FIGS. 3 and 4. The actuating apparatus is mounted on frame 36 attached at a rearward end (farthest away from the air port opening) of the housing 12 which also corresponds to the rearward side of the windbox. The cleaning rod 22 extends through opening 38.

In general, the actuating apparatus 34 comprises an air cylinder 42 having a piston rod 44 attached via rod eye 46 and angular clevis 48 to sleeve 50. Sleeve 50 in turn is secured to fulcrum tube 52 within which cleaning rod 22 slides. The rearward extremity 22*a* of the cleaning rod is attached to rod extension bar 54 connected to the rearward end of air cylinder 42 by means of clevis pin 56. A boot or bellows 58 covers the variable length of the cleaning rod 22 extending rearwardly from tube 52.

Since the tube 52 is pivotally secured at 60 to frame 36, it will be appreciated that actuation of air cylinder 42 for extending piston rod 44 will result in rearward movement of rod extension bar 54 causing withdrawal of the cleaning rod 22 to the left in FIGS. 1–4. However, the opposite actuation of air cylinder 42 will move cleaning rod 22 to the right in FIGS. 1–4 as cleaning rod 22 slides through tube 52 and cleaning tip 20 is extended to the right through the opening between boiler tubes 10.

Figure 9:
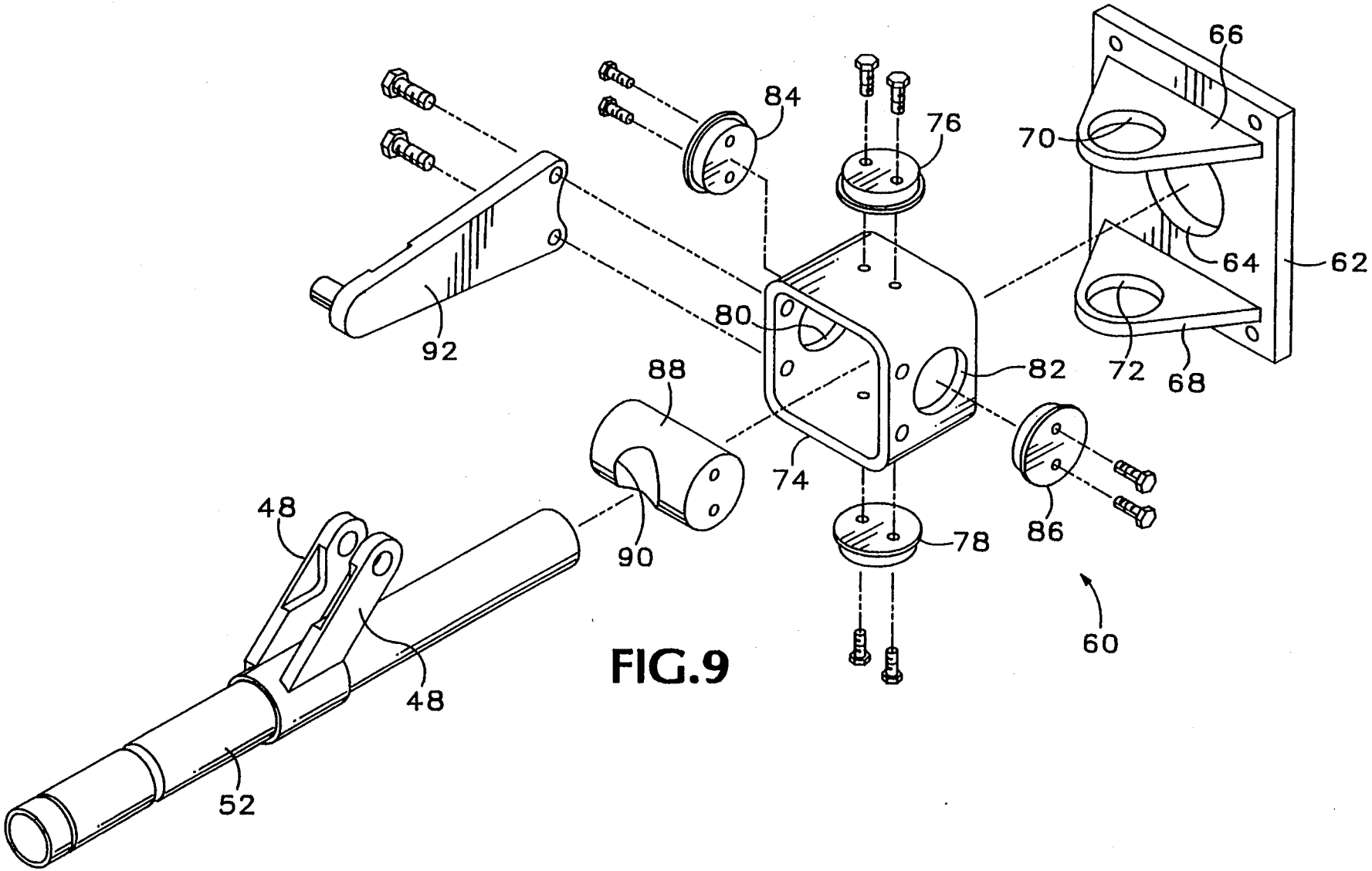
FIG. 9 is an exploded view of a universal mounting assembly for a tube adapted to carry the cleaning rod of the present invention.

Referring particularly to FIGS. 3, 4 and 9, a universal mounting assembly 60 is employed for pivotally carrying the tube 52 which in turn slidable receives cleaning rod 22. A fulcrum bracket 62 is mounted on faceplate 40 where it is provided with a central aperture 64 substantially aligned with opening 38 in housing 12. Upper horizontal fulcrum bracket arm 66 and lower horizontal fulcrum bracket arm 68 extend rearwardly from bracket 62 where they are provided with aligned apertures 70 and 72. A box-like fulcrum housing 74 that is open forwardly and rearwardly carries upper bracket bearing member 76 and lower bracket bearing member 78 matingly received in apertures 70 and 72 whereby fulcrum housing 74 is rotatable about a substantially vertical axis. The transverse side walls of fulcrum housing 74 contain bearing receiving side apertures 80 and 82 within which fulcrum bearing members 84 and 86 are matingly received to provide rotation about a horizontal axis for cylindrical pivot block 88 to which members 84 and 86 are attached. A cylindrical bore, provided through the side of pivot block 88 in substantially perpendicular relation to the cylindrical axis of the pivot block, securely and non-slidably receives fulcrum tube 52. The universal mounting assembly allows tube 52 to be oriented in nearly any angular position within limits suitable for cleaning edges of the air port. The universal mounting assembly also provides a partial air sealing function. A drive mount 92 is attached to one side of fulcrum housing 74 and extends rearwardly therefrom for purposes which will hereinafter become more evident.

Referring particularly to FIG. 3, a stabilizer angle bar 94 is supported below fulcrum tube 52 by means of U-bolt 96 such that bar 94 moves with the tube. A stabilizer rod 98 covered by boot or bellows 100 is attached to bar 94 via flange 102 and extends rearwardly therefrom where it is slidably received in a mating horizontal bore in extension bar 54 whereby the bar is supported as it is moved horizontally along rod 98 by action of air cylinder 42.

Stabilizer bar 94 also supports bracket 104 from which indexing mechanism 106 depends. As hereinafter more fully explained, the indexing mechanism 106 is employed to position the rod 22, and hence cleaning tip 20, so that the small tip can execute a path between insertions thereof around the inside edge of the air port. Therefore a large cleaner member of a size that would block air flow through the air port is not required.

Figure 5:
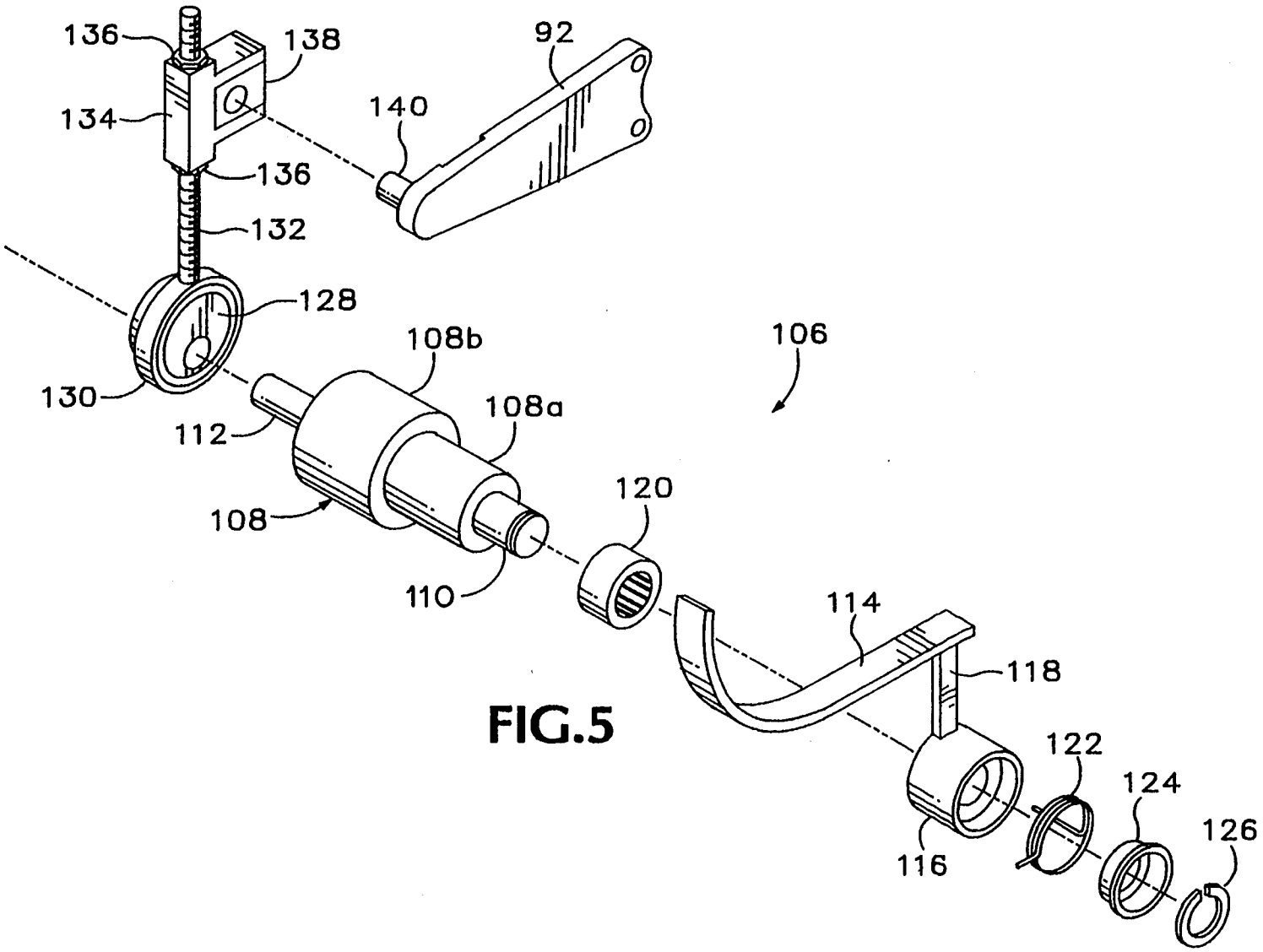
FIG. 5 is an exploded perspective view of a first portion of indexing apparatus according to the present invention.

Referring particularly to FIG. 5, comprising an exploded view of a first portion of the indexing mechanism, bracket 104 (from FIG. 3) carries clutch 108 having an input shaft 110 and an output shaft 112 that are coaxially related and horizontal. The clutch 108 includes a "no-back" portion **108*a* and a torque-limiting portion 108*b*. The no-back clutch portion 108*a* has the following operational characteristics: torque applied to the input shaft 110 is transferred to the output shaft 112, but the output shaft 112 will not move in response to torque applied thereto, and such torque applied to the output shaft 112 is not transferred to the input shaft 110. Torque limiting portion 108*b* is connected between the no-back clutch portion 108*a* and output shaft 112 such that if torque applied to the output shaft exceeds predetermined limits, the clutch allows the output shaft 112** to turn independently. The construction and operation of this type of clutch arrangement are more fully described in the aforementioned U.S. Pat. No. 4,822,428.

Referring again to FIG. 5, a curved actuating arm 114 is attached to hub 116 by way of radial arm 118, the hub 116 being received over clutch input shaft 110 via input bearing 112 constructed to form a drawn cup roller clutch for transmitting torque to the input shaft 110 in one (counter-clockwise) direction while allowing free overrun in the opposite (clockwise) direction. As will be hereinafter more fully explained, actuating arm 114 is utilized for turning the indexing mechanism in the counter-clockwise direction. Input return spring 122, partially received within the forward end of hub 116 and held therewithin by input cup 124 and snap ring 126 as received on shaft 110, is disposed between the hub and the clutch housing for biasing actuating arm 114 in the clockwise direction. The spring normally biases the arm against stop 146 (in FIG. 3).

Clutch output shaft 112 in FIG. 5 operates a first camming means comprising an eccentric 128 secured to output shaft 112 for rotation therewith, the eccentric being rotatably received within peripheral housing 130 carrying upwardly extending connecting rod 132 whereby rotation of shaft 112 brings about relative linear upward movement of rod 132. Rod 132 is threaded and is secured along the length thereof to connecting rod clevis 134 by means of positioning nuts 136. Connecting rod clevis 134 supports connecting rod block 138 receiving a stub shaft 140 that projects from the side of drive mount 92.

Referring to FIGS. 3 and 5, curved actuating arm 114 is positioned for engagement with cam follower roller 142 secured to the forward end of actuating air cylinder 42 by means of cam follower bracket 144. Curved actuating arm 114 is disposed in the path of horizontal movement of cam follower 142 as air cylinder 142 moves back and forth to insert and retract cleaning tip 20. In particular, as the air cylinder moves rearwardly to the left in FIG. 3 for retracting the cleaning tip, the roller 142 engages the curved part toward the rear of actuating arm 114 resulting in counter-clockwise rotation of hub 116, and therefore counter-clockwise rotation of clutch input and output shafts 110 and 112. Consequently, eccentric 128 rotates in a counter-clockwise direction bringing about substantially vertical relative movement of connecting rod 132. Since connecting rod 132 rotatably engages stub shaft 140 of drive mount 92 attached to fulcrum housing 74, the clutch assembly and indexing mechanism are lowered or raised relative to the fulcrum housing, carrying with them stabilizer bar 94 and fulcrum tube 52 as well as the whole mechanism to the left of fulcrum housing 74. Therefore, the rod 22 is moved in a first lateral angular direction (i.e. in a relatively vertical direction) pursuant to retraction of rod 44 by air cylinder 42. Eccentric 128 in FIG. 5 has such proportions that the tip 20 will traverse substantially the whole vertical dimension of the air port for a complete half revolution of the eccentric 128. Of course, rotation of eccentric 128 takes place by steps in accord with desired insertion and retraction locations of the cleaning tip.

Figure 6:
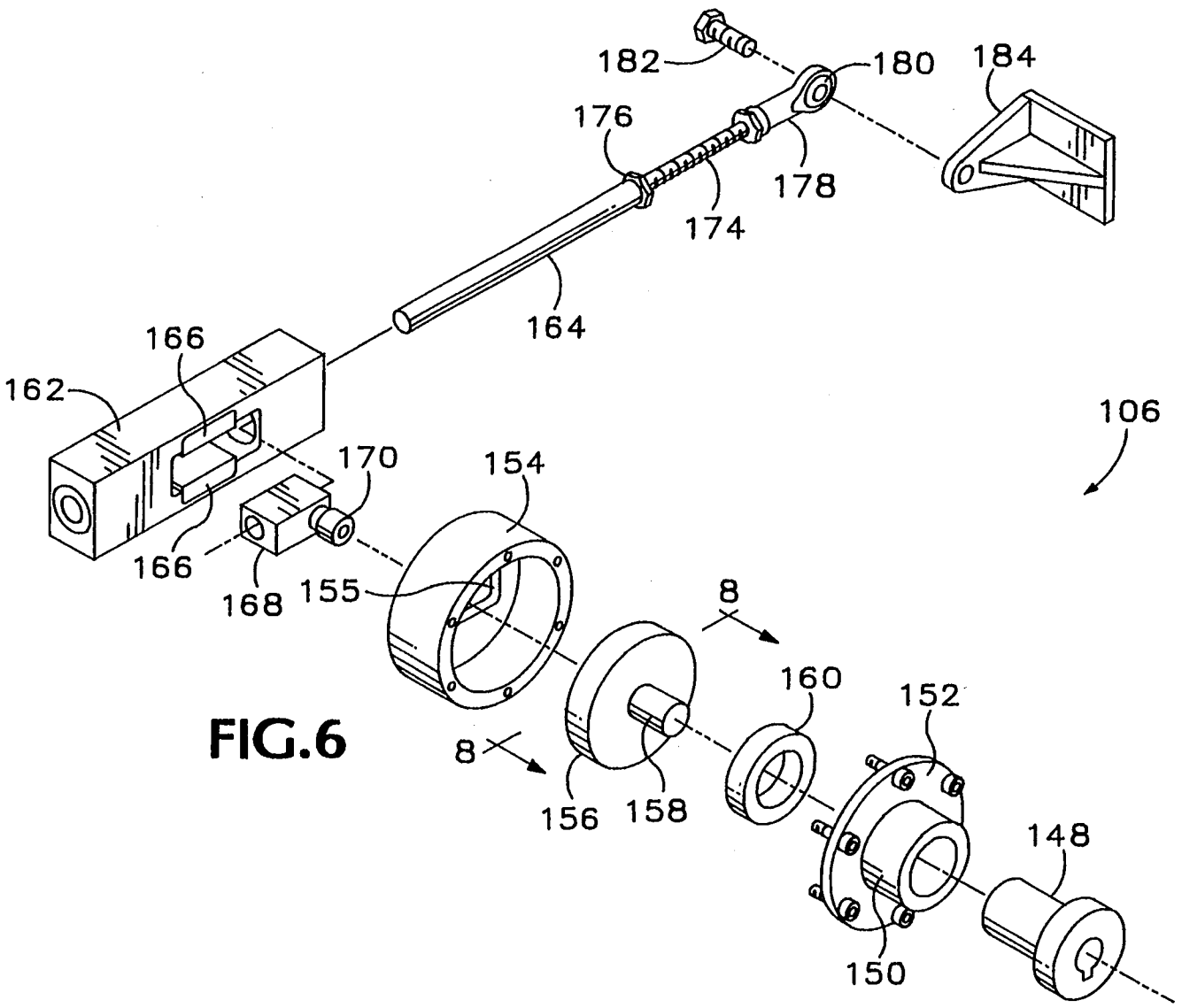
FIG. 6 is an exploded perspective view of a second portion of indexing apparatus according to the present invention.
Figure 8:
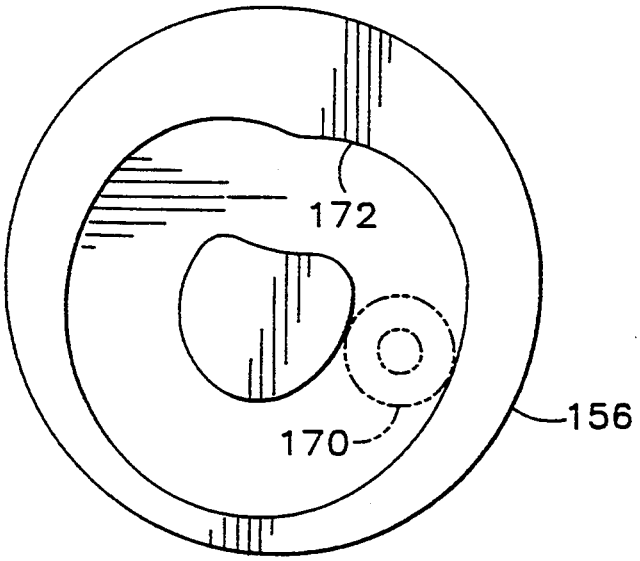
FIG. 8 is a side view of a face cam depicted in the FIG. 6 for indexing means according to the present invention.

Referring now to FIG. 6, illustrating a continuation of the indexing mechanism 106 of FIG. 5 also supported from tube 52, the end of shaft 112 (from FIG. 5) is received in and keyed to quill shaft coupling member 148 rotatably received within axial hub 150 of quill housing 152, wherein quill housing 152 is peripherally secured to the open end of cylindrical face cam housing member 154. A face cam 156 (further illustrated in FIG. 8) is provided with a central stub shaft 158 adapted to pass through thrust washer 160 and engage quill shaft coupling member 148 for rotation therewith. Face cam member 156 is coaxial with and rotates together with clutch output shaft 112 in FIG. 5.

Face cam housing member 154 in FIG. 6 is secured to slider housing 162 having bearings at either end for receiving push rod 164 that extends somewhat upwardly and to the right. Within slider housing 162 a pair of plates 166 slidably receive cam roller block 168 which is attached to push rod 164. Block 168 carries cam roller 170 that engages track 172 of face cam 156 via opening 155 in the face of the cam housing. Track 172 suitably has a heart shape such that rotation of cam 156 through one revolution moves roller 170, and hence push rod 164, back and forth through a complete cycle.

Push rod 164 has an adjusting rod portion 174 threadably received within the main portion of the push rod and secured thereagainst by jam nut 176. The opposite end of the adjusting rod portion 174 carries rod eye 178 having a pivotable bolt receiving portion 180 through which bolt 182 extends for engaging bracket 184 secured to faceplate 40. (See FIG. 4.)

As clutch shafts 110 and 112 are rotated in response to movement of actuating arm 114, cam 156 is rotated in coordinated relation with eccentric 128, whereby the cleaning rod 22 and hence tip 20 are moved in a side-to-side direction at the same time the rod and tip are moved vertically. Thus, as the face cam 156 rotates through part of a revolution due to engagement of actuating arm 114 by roller 142, roller 170 and hence push rod 164 are caused to execute relatively horizontal movement (at an angle to the horizontal inasmuch as push rod 164 extends somewhat upwardly toward bracket 184 as seen in FIG. 3). Since bracket 184 is secured to the faceplate, the entire indexing mechanism and clutch assembly are caused to move horizontally with respect to the faceplate, carrying therewith bar 94 and the entire mechanism rearwardly of fulcrum housing 74. Inasmuch as fulcrum tube 52 is moved from side-to-side, cleaning rod 22 and tip 20 are angularly translated horizontally.

The operation of each of camming means 128 and 156 is adjusted for proper throw and coordination whereby, when camming means 128 determines the upper extent of movement of tip 20 within the air port (see FIG. 7), the camming means 156 will cause positioning of tip 20 halfway between its left and right extremities. As will be understood by those skilled in the art, the path shape and extent of movement in horizontal and vertical directions in the lateral plane of the air port are readily selectable through selection of cam configuration.

Considering overall operation, a cleaning cycle around the opening consists of a series of insertions and retractions of the cleaning tip 20, each insertion and retraction occurring at a different point along a path proximate the edge of the air port, e.g. in a path following around the inside edge of the opening. The cleaning cycle typically begins from a rest position with the tip then being inserted by actuation of air cylinder 42 to withdraw rod 44 within the cylinder and to cause cleaning rod 22 to move forwardly in a ramming action. When the cylinder 42 reaches the end of its stroke, it is then operated for extending rod 44, thereby withdrawing rod 22. Over the last few inches of the retraction stoke, cam follower 142 contacts actuating arm 114 at the rearward curved portion thereof such that shaft 110 and shaft 112 are rotated. Rotation of shaft 112 brings about rotation of camming means 128 and 156, causing the cleaning tip 20 to traverse relative the edge of the air port opening 18 to a next position, as may be suitably spaced from the previous position. The foregoing cycle then repeats. After a predetermined number of extensions and withdrawals of the cleaning rod 22, the cleaning tip 20 will have traversed completely around the inside edge of the air port to dislodge residual build-up. Ordinarily, this action as described is sufficient to clean the edge of the air port with each stroke of the cleaning tip. However, in the event that the entire opening is blocked, with residual material extending completely across the opening, the tip perforates the build-up whereby the residual material falls out or is blown out by the air flow through the opening when several perforations have been made by the cleaning tip.

The apparatus described above moves the cleaning tip 20 a fraction of the distance across the air port opening in a first or "y" lateral direction (approximately vertically) by means of eccentric 128 between insertions of the tip into the air port (in the "z" direction), and moves the cleaning tip a fraction of the distance across the air port opening in a second or "x" lateral direction (approximately horizontally) by means of cam 156 between insertions of the tip 20. In a typical example the respective camming means move the cleaning tip approximately one-eighth of the distance across the opening in each lateral direction pursuant to each tip insertion and retraction for a total of sixteen insertion points along the inside perimeter of the opening. However, the extent of lateral movement of the cleaning tip between insertions is readily selectable. Also the points of an insertion need not remain constant for successive traversals around the inside perimeter.

Figure 10:
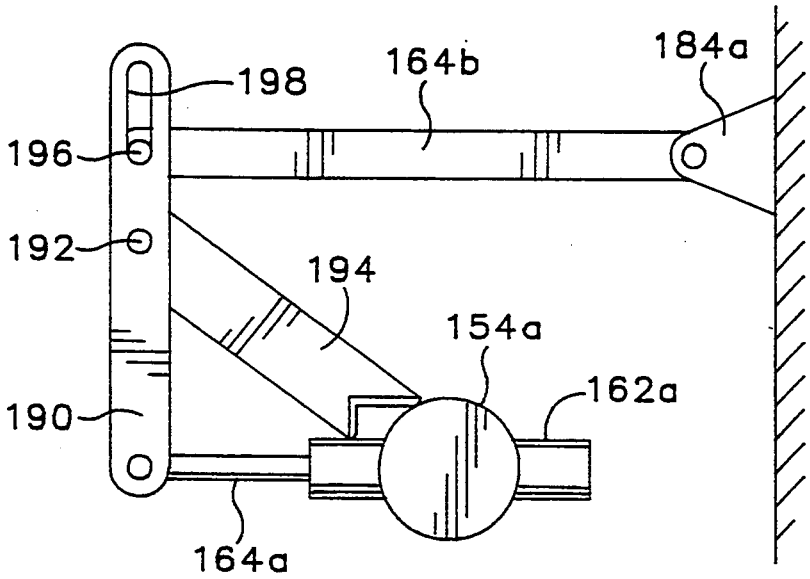
FIG. 10 is a side view of an alternative construction for a camming push rod mechanism according to the present invention.

As hereinbefore described, the push rod 164 illustrated in FIGS. 3 and 6 is disposed somewhat at an angle. The axis of turning of rod eye 178 about bolt 182 is substantially in line with the axis of turning of the fulcrum rod 52 about bearing 86 in the vertical direction. This construction has advantages of simplicity of construction but can be replaced with the configuration as illustrated in FIG. 10 wherein similar elements are identified with corresponding reference numerals followed by a lower case letter. In the construction illustrated in FIG. 10, push rod 164 of FIG. 6 is replaced by a first push rod section **164*a* and a second push rod section 164*b* which are both substantially horizontally disposed and joined by an intervening lever arm 190 supported at pivot point 192 in common with the overall indexing mechanism via support 194. In this instance, movement of push rod 164 in response to operation of the face cam 156 (not shown in FIG. 10) turns lever 190 and urges the indexing mechanism as well as the complete structure carrying the cleaning rod away from or toward bracket 184*a* mounted on the faceplate. This construction provides advantages of reduced free play, inasmuch as the effective free play from the face cam can be reduced. That is, the face cam can be made larger with the degree of play remaining the same. In addition, the mechanism can be easily adjusted by adjustably mounting pivot point 196 along slot 198** to vary the extent of horizontal movement. Also no downward component of force is produced by the push rod.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. Apparatus for cleaning an opening in a furnace, said apparatus comprising:

a rod provided with a cleaning tip smaller in both x and y lateral directions than said opening and adapted for insertion into said opening;

means for translating said rod along a longitudinal direction of said rod relative to said opening for successively inserting said tip into said opening to dislodge residual buildup therefrom; and means for automatically indexing said tip for enabling said successive insertions thereof into said opening at different locations, said indexing defining a path for successive insertions around the inside edge of said opening, including first means for moving said tip in a first lateral direction as defined across said opening, and second means for moving said tip in a second lateral direction in coordination with movement of said first means, for executing said path around the peripheral inside edge of said opening, said second lateral direction being defined across said opening at an angle to said first lateral direction.

2. The apparatus according to claim 1 wherein said first means moves said tip a fraction of the distance across said opening in said first lateral direction, and wherein said second means moves said tip a fraction of the distance across said opening in said second lateral direction to enable successive insertions of said tip into said opening at successive locations a fraction of the distance around the inside edge of said opening.

3. Apparatus for cleaning an elongated opening of variable width in a chemical recovery furnace, said apparatus comprising:

a rod provided with a cleaning tip smaller than said opening adapted for insertion into said opening and comprising an elongate member having a serrate edge;

means for translating said rod in a longitudinal direction for inserting said cleaning tip into said opening and retracting said cleaning tip from said opening to dislodge residual buildup therefrom; and indexing means responsive to said translating means for changing an angular position of said rod so as to control a point of insertion of said cleaning tip into the opening as well as the point of retraction of said cleaning tip from said opening;

said indexing means comprising first means for moving said tip by changing the angular position of said rod in a first lateral direction across said opening and second means for moving said tip by changing the angular position of said rod in a second lateral direction across said opening in coordination with movement of said first means to index said tip for successive insertions around a path immediately inside the edge of said opening.

4. Apparatus for cleaning an elongated opening of variable width in a firebox of a chemical recovery furnace, said apparatus comprising:

a rod with a cleaning tip adapted for insertion into said opening, said cleaning tip being substantially smaller than said opening; and actuating means for advancing said rod in a direction longitudinal of said rod toward the opening to insert said cleaning tip into the opening, said cleaning tip entering the opening at a first point of insertion, said actuating means including means for subsequently retracting said rod to withdraw said cleaning tip from the opening and including means responsive to the retracting of said rod for pivoting said rod about a first pivot axis so as to move said cleaning tip in a lateral direction across a width of said opening and means responsive to the retracting of said rod for pivoting said rod about a second pivot axis that is primarily perpendicular to said first pivot axis so as to move said cleaning tip in a longitudinal direction along a length of said opening wherein the cleaning tip is positioned for reinsertion into the opening at a second point located along the perimeter of the opening away from the first point of insertion.

5. Apparatus for cleaning an opening in a chemical recovery furnace, said opening having a variable width, said apparatus comprising:

a rod provided with a cleaning tip adapted for insertion into the opening, said cleaning tip being substantially smaller than the opening in lateral directions of said opening;

means for providing longitudinal translation of said rod relative to the opening to insert said cleaning tip into said opening for dislodging residual buildup therefrom;

means for providing lateral translation of said rod in a lateral plane substantially perpendicular to said rod; and means for causing a first actuation of said longitudinal translation means to clean a first portion of said opening and for subsequently causing a second actuation of said longitudinal translation means to clean a second portion of said opening after lateral translation of said rod to position said tip proximate said second portion along the edge of said opening from said first portion, said second portion being spaced from said first portion in both lateral x and y directions;

said means for providing lateral translation of said rod being responsive to said longitudinal translation of said rod for automatically providing said lateral translation as a result of actuation of said longitudinal translation means.

6. The apparatus according to claim 5 wherein said lateral translation means includes a clutch and camming means responsive to the output of said clutch for moving said rod in first and second lateral directions.

7. The apparatus according to claim 5 wherein said lateral translation means includes first camming means interposed between said rod and a reference bearing for causing lateral movement of said rod in a first lateral direction.

8. The apparatus according to claim 7 wherein said lateral translation means includes second camming means interposed between said rod and a second reference bearing for causing lateral movement of said rod in a second or y direction.

9. The apparatus according to claim 8 wherein said first lateral direction comprises the width direction of said opening and said reference bearing is attached to a mount for said apparatus.

10. The apparatus according to claim 7 wherein said second lateral direction is substantially along the direction of elongation of said opening and said reference bearing comprises pivotal bearing means for said rod.

* * * * *